US005291871A

United States Patent [19]

Shirai

[11] Patent Number: 5,291,871

[45] Date of Patent: Mar. 8, 1994

[54] SUPERCHARGED DIESEL ENGINE

[75] Inventor: Makoto Shirai, Toyohashi, Japan

[73] Assignee: Aisin Seiki Kabushiki Kaisha, Kariya, Japan

[21] Appl. No.: 818,131

[22] Filed: Jan. 8, 1992

[30] Foreign Application Priority Data

Jan. 18, 1991 [JP] Japan ..... 3-004199

[51] Int. Cl.[5] ..... F02B 33/00

[52] U.S. Cl. ..... 123/564

[58] Field of Search ..... 123/559.3, 564; 60/609

[56] References Cited

U.S. PATENT DOCUMENTS 4,738,110 4/1988 Tateno ..... 60/609 X

FOREIGN PATENT DOCUMENTS 265332 11/1986 Japan ..... 123/564

62-276225 12/1987 Japan .

85220 4/1988 Japan ..... 123/564

156124 7/1991 Japan .

*Primary Examiner*—Michael Koczo

*Attorney, Agent, or Firm*—Oblon, Spivak, McClelland, Maier & Neustadt

[57] ABSTRACT

A supercharged diesel engine is comprised an intake pipe, a diesel engine which is including an air cleaner and a cylinder which are installed both end of the intake pipe, respectively, a supercharger provided in the intake pipe and set to be driven by the diesel engine via clutch device, a bypass passage which is installed in the intake pipe in parallel with the supercharger, a bypass valve and a throttle device which are arranged on the bypass passage in series and the supercharger being supplied air in the case of that the bypass valve is opened and being rotated by the air.

9 Claims, 4 Drawing Sheets

SUPERCHARGED DIESEL ENGINE

BACKGROUND OF THE INVENTION

1. Field of the Invention

This invention relates to a supercharged diesel engine.

2. Description of the Related Art

In general, a diesel engine is equipped with a turbocharger for improving the output power or torque of the diesel engine. In the turbocharger, since a compressor is of the centrifugal type, a pressure to be supplied to the engine will not increase while an output pressure of a turbine remains low. Thus, while the engine is in a low speed region, the power efficiency of the turbocharger is not good because it is difficult to increase output power or torque of the engine. Moreover the turbocharger has a characteristic turbo-lag so that it takes a long time for power to build up after depressing the accelerator if the car is equipped with a turbocharged diesel engine.

On the other hand, a supercharger is often equipped to a gasoline engine in order to increase its output power or torque instead of the turbocharger. The supercharger does not have the above problems.

In light of this, when the diesel engine is equipped with the supercharger, it is necessary to make the rotational speed amplification between an output shaft of the diesel engine and the supercharger larger than that between an output shaft of the gasoline engine and the supercharger.

In general, the output shaft of the diesel engine is connected to the supercharger via belt means and clutch means. The clutch means is held at its disengaged condition and engaged condition while the supercharger is in its rest condition and operation condition, respectively.

As the clutch means changes from the engaged condition to the disengaed condition, the differential rotational number across the clutch or the rotational number of the diesel engine relative to that of the supercharger becomes large. Therefore the load to the clutch means upon its engagement becomes so big that opposed friction surfaces of the clutch wear rapidly and a danger may occur that the supercharging of the engine becomes impossible.

SUMMARY OF THE INVENTION

It is an object of the invention to provide an improved supercharged diesel engine which obviates the above conventional drawbacks.

It is another object of the invention to provide an improved supercharged diesel engine in which the load to be applied to the clutch means is reduced.

In order to attain the foregoing objects, a supercharged diesel engine is comprised of an intake pipe, a diesel engine including an air cleaner and a cylinder which are installed at both ends of the intake pipe, respectively, a supercharger provided in the intake pipe and set to be driven by the diesel engine via a clutch device which is installed in the intake pipe in parallel with the supercharger, a bypass element and a throttle valve device which are arranged on the bypass passage in series and the supercharger being supplied air in the case of that the bypass valve is opened and being rotated by the air.

BRIEF DESCRIPTION OF THE DRAWINGS

The above and other objects, features and advantages of the present invention will be more apparent and more readily appreciated from the following detailed description of preferred exemplary embodiments of the present invention, taken in connection with the accompanying drawings, in which.

DESCRIPTION OF THE PREFERRED EMBODIMENTS

Figure 1:
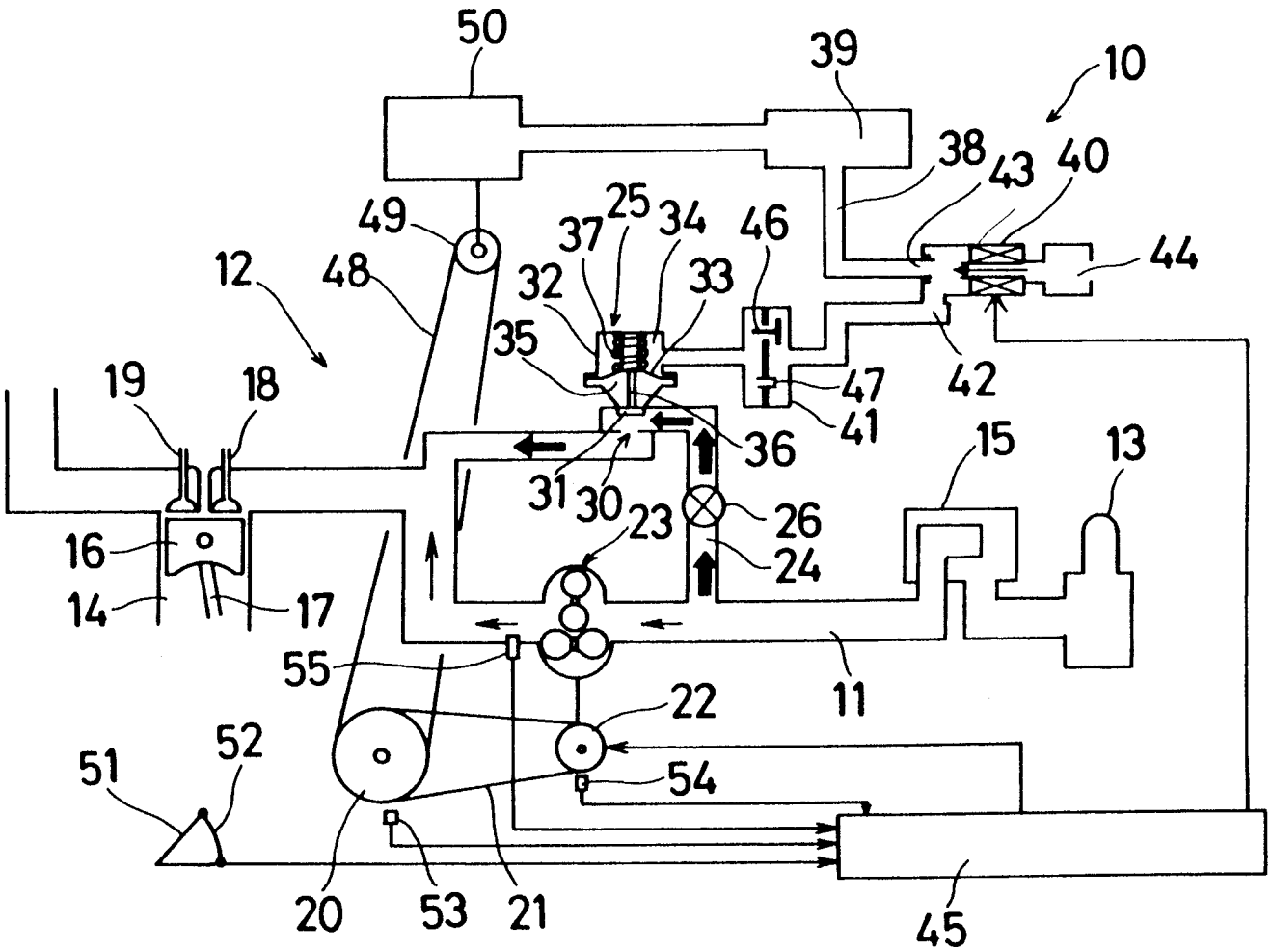
FIG. 1 is a schematic illustration of a supercharged diesel engine in its non-supercharging condition according to this invention.

Referring to FIG. 1, there is illustrated a supercharged diesel engine system 10. An air cleaner 13 and a cylinder 14 are installed at both ends of an intake pipe 11, respectively. It should be noted that though FIG. 1 shows only one cylinder the number of cylinders can not be restricted and plural cylinders may be installed. A resonator 15 is provided at a downstream side of the air cleaner 13 in the intake pipe 11. As well known, a piston 16, a connecting rod 17, an exhaust valve 19 and an intake valve 18 are equipped in the cylinder 14.

Between the air cleaner 13 and the cylinder 14 in the intake pipe 11, a supercharger 23 is disposed which is driven by the diesel engine 12 via a crank pulley 20 which is connected to an output shaft (not shown) of the diesel engine 12, a belt 21 and an electromagnetic clutch (clutch means) 22.

Figure 4:
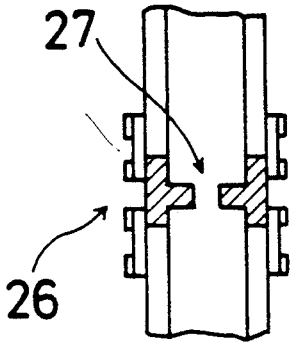
FIG. 4 is a cross sectional view of an orifice means.
Figure 5:
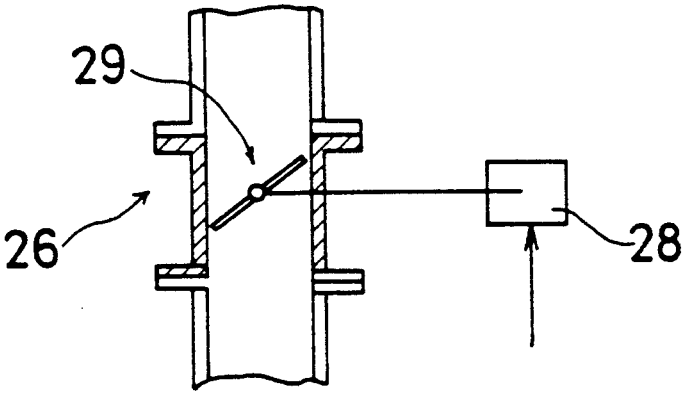
FIG. 5 is a cross sectional view of another orifice means.

A bypass passage 24 connects to the inhalation pipe 11 so as to be in parallel relationship with the supercharger 23 and a bypass valve 25 and a restriction means in the form of a throttle element 26 are arranged in the bypass passage 24 in series. As the throttle element 26, an orifice 27 shown in FIG. 4, a butterfly valve 29 rotated by an actuator 28 which is shown in FIG. 5, or similar device is available. The actuator 28 could control the butterfly valve to provide any desired degree of restriction. It is thus possible to control the speed by which the intake air drives the supercharger.

The bypass valve 25 opens and closes a connection hole 30 in the bypass passage 24 via a valve body 31. A space in a housing 32 of the bypass valve 25 is separated airtightly into a first chamber 34 and a second chamber 35 by a diaphragm 33. One end of a rod 36 installed in the second chamber 35 is fixed to the valve body 31 and the other end thereof is fixed to the diaphragm 33. On the other hand, a spring 37 mounted in the first chamber 3 is set to urge the valve body 31 to close the connection hole 30 via the diaphragm 33 and the rod 37.

The first chamber 34 is connected with a negative-pressure tank 39 through a negative-pressure supplying passage 38 and a negative-pressure control valve 40 and a negative-pressure retarding valve 41 are arranged in the negative-pressure supplying passage 38 in series. The negative-pressure supplying passage 38 includes three ports 42, 43 and 44 and the port 42 is set to be brought into fluid communication with either the port 43 or the port 44 according to a signal from a controller 45. The negative-pressure retarding valve 41 includes a one-way valve 46 and an orifice 47. The flow of the fluid from the first chamber 34 to the port 42 flows easily through the one-way valve 46, but the flow of the fluid from the port 42 to the first chamber 34 is restricted by the orifice 47. It is noted that the port 44 is opened to the air.

The negative-pressure tank 39 is supplied with a negative-pressure from a negative-pressure pump 50 which is driven by the diesel engine 12 via a belt 48 and a pulley 49.

The controller 45 is provided with output signals from various sensors such as an acceleration open sensor 52 to be actuated together with an acceleration pedal 51 of a vehicle on which the supercharged diesel engine is mounted, a crank speed sensor 53 to be actuated together with the crank pulley 20, a clutch speed sensor 54 installed on the electromagnetic clutch 22 and a supercharged pressure sensor 55 which is installed at the downstream side of the supercharger 23 of the intake pipe 11, and so on. The controller 45 controls the negative-pressure control valve 40 and the electromagnetic clutch 22.

The electromagnetic clutch 22 includes a pair of opposed friction surfaces (not shown) and one of the friction surfaces is rotated by the belt 21 connected thereto and the other is connected to a rotating output shaft (not shown) of the supercharger 23. An amplification of the rotational speed between the crank pulley 20 and the electromagnetic clutch is determined larger because the rotational number of the diesel engine 12 is low.

In operation, at first, if the controller 45 judges, based on the output signals from the accelerator open sensor 52 and the crank speed sensor 53, that the diesel engine 10 is in the idling condition or the lightly loaded condition, as shown in FIG. 1, the controller 45 provides signal to the electromagnetic clutch 22 for the prevention of the actuation of the supercharger 23. At the same time the controller 45 controls the negative-pressure control valve 40 to connect the port 42 with the port 43 so that negative pressure is supplied from the negative-pressure tank 39 to the first chamber 34 of the bypass valve 25 and the valve body 31 which is to be moved together with the diaphragm 33 and the rod 36 opens the connection hole 30.

Therefore most air which flows in the intake pipe 11 from the the air cleaner 13 is supplied to the cylinder 14 through the bypass passage 24 around the supercharger 23. However, since the bypass passage 24 is installed with the throttle element 26 by which the amount of air is limited, the supercharger 23 is also supplied with the air and it makes the supercharger 23 rotate. In the case of the butterfly valve 29, it may be controlled as a function of the clutch speed detected by clutch speed sensor 54 so that clutch load is minimized during clutch engagement.

Thus, the rotational number difference between the friction surfaces is small though the electromagnetic clutch 22 is in the disengaged condition.

Figure 2:
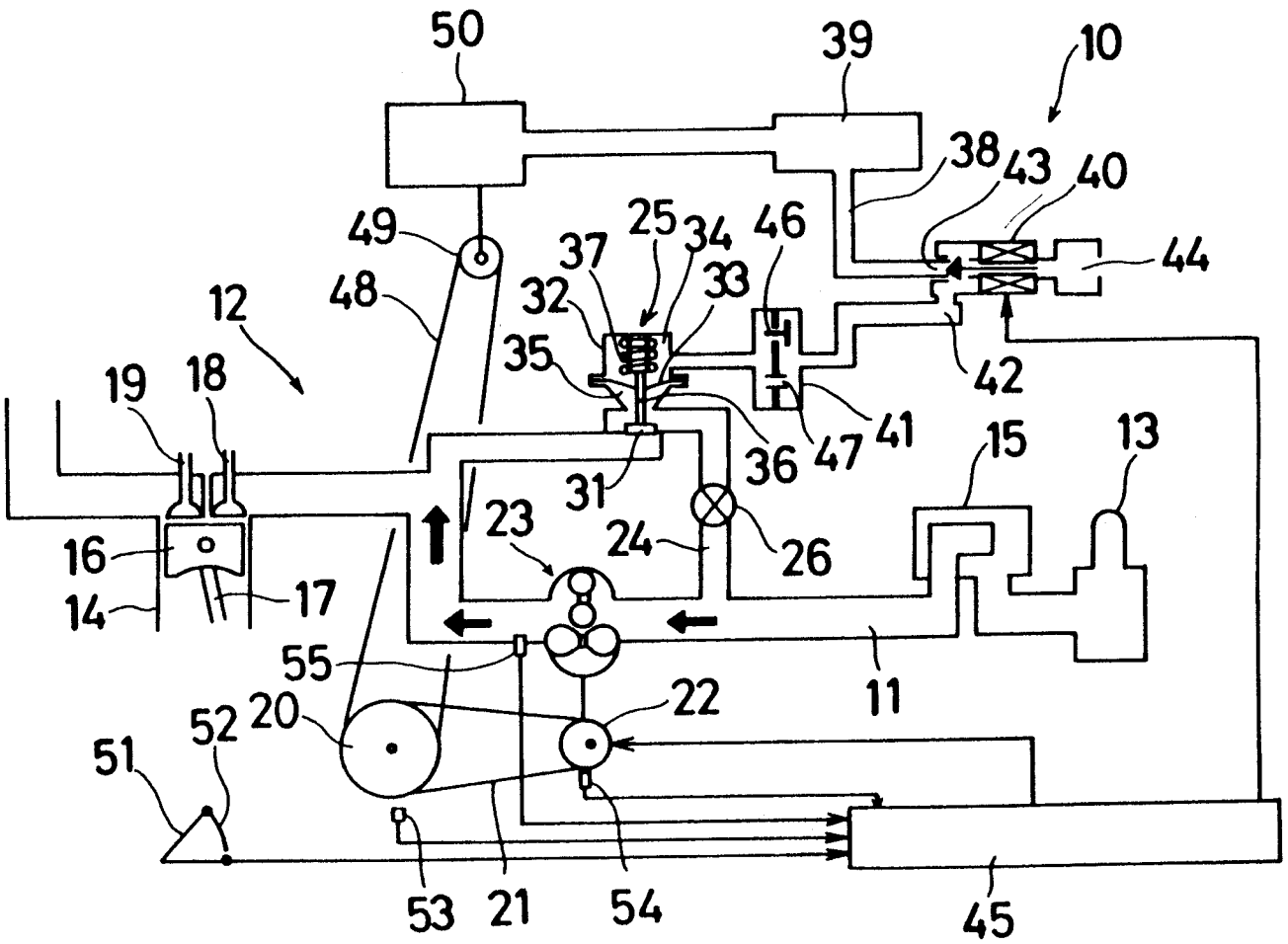
FIG. 2 is a schematic illustration of a supercharged diesel engine in its supercharging condition according to this invention.

If the controller 45 judges, based on the output signals from the acceleration open sensor 52 and the crank speed sensor 53, that the diesel engine 10 is in the highly loaded condition, the controller 45 provides the signal to the electromagnetic clutch 22 to initiate or drive the supercharger by means of diesel engine 12. At the same time the controller 45 controls the negative-pressure control valve 40 to connect the port 42 with the port 44 (FIG. 2) so that atmospheric pressure is supplied to the first chamber 34 of the bypass valve 25 and the valve body 31 closes the connection hole 30 as a result of the movements of the diaphragm 33 and the rod 36. At this time, since the atmospheric pressure is supplied through the orifice 47 to the first chamber 34, the valve body 31 closes the connection hole 30 gradually, preventing the abrupt pressure increase up to the atmospheric pressure in the first chamber 34.

Therefore all air which flows in the intake pipe 11 from the air cleaner 13 is supplied to the cylinder 14 by the supercharger 23. In this embodiment the bypass passage 24 closes gradually so that the load to be applied to the supercharger 23 increased gradually. As mentioned above, the rotational number difference between the friction surfaces is small so that the load change which the electromagnetic clutch receives is small which leads to less wear in each of of the friction surfaces, and the longevity of the electromagnetic clutch 22 is assured.

Figure 3:
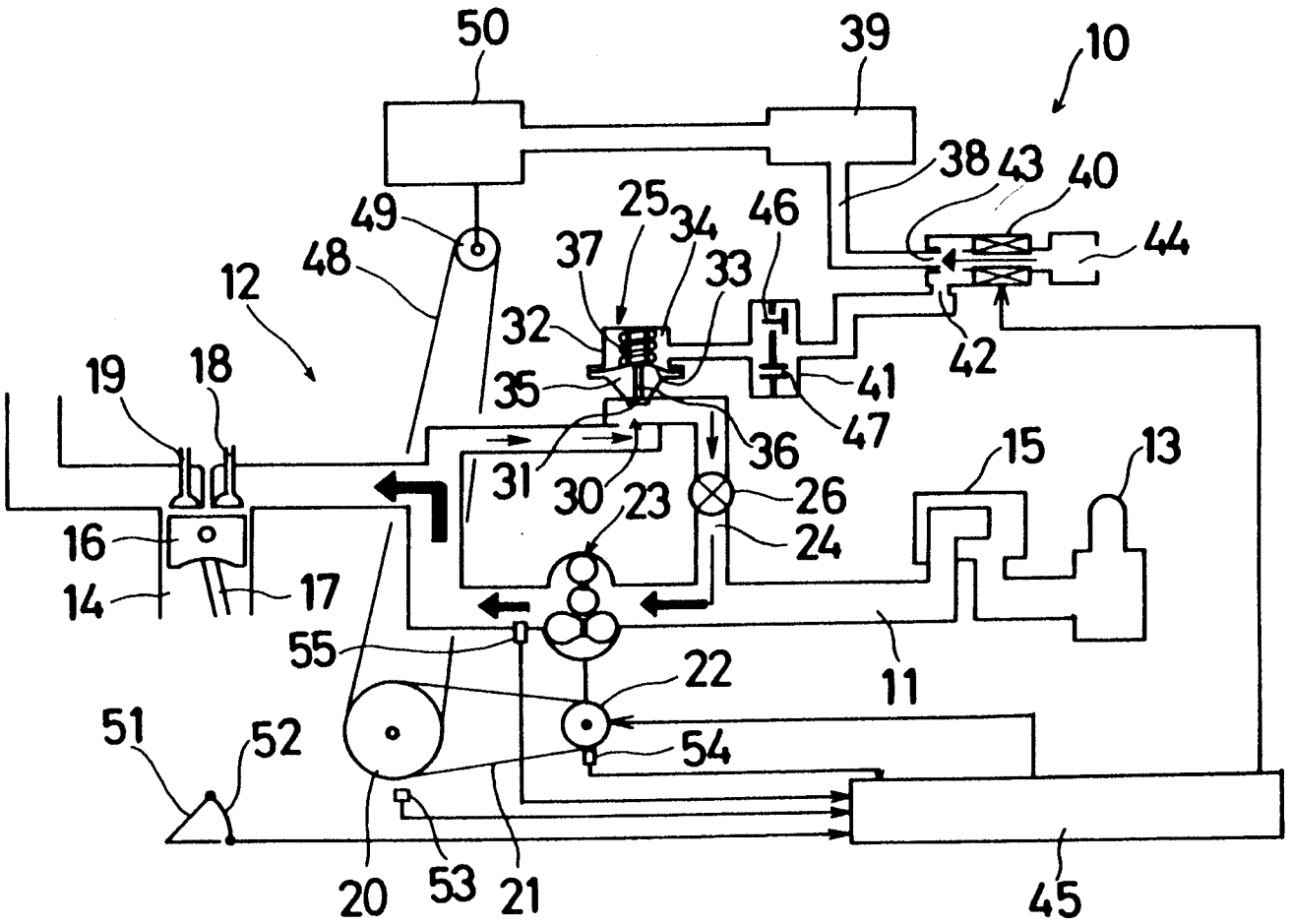
FIG. 3 is a schematic illustration of a supercharged diesel engine in its relief condition according to this invention.

In the case that the exhausted pressure from the supercharger 23 is too high in this supercharged state, the valve body 31 opens the connection passage 30 against the biasing force of the spring 37 in the bypass valve 25 as shown FIG. 3 and the higher pressure is vented upstream of the supercharger 23 through the bypass passage 24.

In the above mentioned device, even though the electromagnetic clutch 22 is in its disengaged condition and the supercharger 23 is not driven, the supercharger is supplied with an amount of air to some extent through the throttle element 26 installed in the bypass passage so that the supercharger 23 rotates by the air flow. In addition the rotational number difference between the friction surfaces is small so that the wear of each of the friction surfaces decreases.

Obviously numerous modifications and variations of the present invention are possible in light of the above teachings. It is therefore to be understood that within the scope of the appended claims, the invention may be practiced otherwise than as specifically described herein.

What is claimed is:

1. A supercharged diesel engine comprising:

an intake pipe;

a diesel engine including an air cleaner and a cylinder which are installed at both ends of said intake pipe, respectively;

a supercharge provided in said intake pipe and set to be driven by said diesel engine via clutch means;

a bypass passage which is installed in said intake pipe in parallel with said supercharger;

a bypass valve and restriction means which are arranged on said bypass passage in series; and said restriction means restricting said bypass passage sufficiently such that said supercharger receives sufficient air that said supercharger is rotated by the air in the case that said clutch means is disengaged and said bypass valve is opened, thereby reducing friction wear of the clutch means.

2. A supercharged diesel engine according to claim 1, in which said restriction means comprises an orifice.

3. A supercharged diesel engine according to claim 1, in which said restriction means comprises a butterfly valve and an actuator rotating said butterfly valve to provide a variable restriction.

4. A supercharged diesel engine according to claim 1 further comprising a negative-pressure tank fluidically connected to said bypass valve and a negative pressure retarding valve connected between said negative pressure tank and said bypass valve for retarding an application of negative pressure from said source to said bypass valve.

5. A supercharged diesel engine according to claim 4 further comprising a negative-pressure control valve connected between said negative-pressure retarding valve and said negative-pressure tank.

6. A supercharged diesel engine according to claim 5 further comprising a sensor detecting a speed of a clutch means which connects said supercharger with a driving means and a controller which controls said negative-pressure control valve by provided signals from said sensor.

7. A supercharged diesel engine according to claim 4, in which said negative-pressure retarding valve comprises an orifice, a one-way valve which is installed with said orifice in parallel, wherein air flows into said bypass valve through said orifice gradually and flows out through said one-way valve.

8. A supercharged diesel engine according to claim 4, in which said bypass valve includes a housing, a diaphragm which divides said housing to first chamber and second chamber, a rod which end is connected to said diaphragm in said second chamber, a valve body which is connected to the other end of said rod in said second chamber, said first chamber is communicated with said negative-pressure retarding valve, and said valve body is opened or closed by negative-pressure.

9. A supercharged diesel engine according to claim 1 wherein said restriction means comprises means for providing a variable restriction.

* * * * *